US011549424B2

(12) United States Patent
Raghunath et al.

(10) Patent No.: US 11,549,424 B2
(45) Date of Patent: Jan. 10, 2023

(54) SYSTEM, APPARATUS, AND METHOD FOR PROTECTION AND CLEANING OF EXHAUST GAS SENSORS

(71) Applicant: Cummins Inc., Columbus, IN (US)

(72) Inventors: Ganesh Raghunath, Columbus, IN (US); Shu Li, Columbus, IN (US)

(73) Assignee: Cummins Inc., Columbus, IN (US)

( * ) Notice: Subject to any disclaimer, the term of this patent is extended or adjusted under 35 U.S.C. 154(b) by 0 days.

(21) Appl. No.: 16/951,240

(22) Filed: Nov. 18, 2020

(65) Prior Publication Data

US 2021/0079829 A1 Mar. 18, 2021

Related U.S. Application Data

(63) Continuation of application No. PCT/US2019/037457, filed on Jun. 17, 2019.
(Continued)

(51) Int. Cl.
*F01N 13/00* (2010.01)
*F01N 3/05* (2006.01)
(Continued)

(52) U.S. Cl.
CPC ..... *F01N 13/008* (2013.01); *F01N 3/05* (2013.01); *F01N 3/0892* (2013.01); *F01N 11/00* (2013.01);
(Continued)

(58) Field of Classification Search
CPC ..... F01N 13/008; F01N 3/05; F01N 3/0892; F01N 11/00; F01N 2240/16;
(Continued)

(56) References Cited

U.S. PATENT DOCUMENTS 4,091,835 A * 5/1978 Frampton ..... G05D 7/0173 137/499
4,864,821 A 9/1989 Hoch
(Continued)

FOREIGN PATENT DOCUMENTS

DE 102013005572 10/2014
EP 2116843 11/2009
(Continued)

OTHER PUBLICATIONS

Search Report and Written Opinion, PCT Appln. No. PCT/US19/37457, dated Sep. 11, 2019, 10 pgs.
(Continued)

*Primary Examiner* — Brandon D Lee
(74) *Attorney, Agent, or Firm* — Taft, Stettinius & Hollister LLP

(57) ABSTRACT

A system, apparatus, and method are provided for preventing the accumulation of particulate matter such as combustion soot on sensors positioned in exhaust gas conduits of internal combustion engines. In an embodiment, the apparatus includes a device for deflecting soot deposits from sensor surfaces. In an embodiment, the apparatus includes a device employing a surface acoustic wave generator for dislodging soot accumulation or measuring soot accumulations to trigger burn-off events. In an embodiment, an injector injects pressurized bursts of gas toward a sensor surface to dislodge particulate matter. In an embodiment, charged electrodes attract charged particles of soot from the exhaust gas flow to form deposits that are then subject to burn-off events.

6 Claims, 10 Drawing Sheets

Related U.S. Application Data

(60) Provisional application No. 62/686,237, filed on Jun. 18, 2018.

(51) Int. Cl.
*F01N 3/08* (2006.01)
*F01N 11/00* (2006.01)

(52) U.S. Cl.
CPC ..... *F01N 2240/16* (2013.01); *F01N 2240/20* (2013.01); *F01N 2560/02* (2013.01); *F01N 2560/06* (2013.01); *F01N 2560/07* (2013.01)

(58) Field of Classification Search
CPC ..... F01N 2240/20; F01N 2560/06; F01N 2560/07; F01N 3/027; F01N 2560/025; F01N 3/037
See application file for complete search history.

(56) References Cited

U.S. PATENT DOCUMENTS

| | | | | |
|---|---|---|---|---|
| 7,950,222 | B2 | 5/2011 | Hodzen | |
| 8,310,249 | B2 | 11/2012 | Paterson | |
| 2010/0263187 | A1 | 10/2010 | Matviya | |
| 2010/0275781 | A1 | 11/2010 | Tsangaris et al. | |
| 2013/0283887 | A1 | 10/2013 | Ante et al. | |
| 2013/0298640 | A1 | 11/2013 | Ante et al. | |
| 2014/0234873 | A1* | 8/2014 | Leck | G01N 1/31 435/7.1 |
| 2015/0047330 | A1* | 2/2015 | Zhang | F01N 3/28 60/311 |
| 2015/0211429 | A1 | 7/2015 | Hocken et al. | |
| 2016/0131013 | A1 | 5/2016 | Yi et al. | |
| 2016/0175784 | A1* | 6/2016 | Harmon | B01F 23/2132 366/167.1 |
| 2017/0058748 | A1* | 3/2017 | Zhang | G01N 15/0656 |
| 2018/0023447 | A1* | 1/2018 | Zhang | B01F 5/0689 422/168 |
| 2019/0017426 | A1* | 1/2019 | Zhang | B01F 23/10 |
| 2019/0271629 | A1* | 9/2019 | Zhang | G01N 15/0618 |

FOREIGN PATENT DOCUMENTS

| | | |
|---|---|---|
| GB | 2285094 | 6/1995 |
| JP | 2011033577 | 2/2011 |
| WO | 2016109495 | 7/2016 |

OTHER PUBLICATIONS

Go, David B. Surface Acoustic Wave Devices for Chemical Sensing and Microfluidics; a Review and Perspective, Analytical Methods, Jun. 13, 2017, pp. 4112-4134.

* cited by examiner

SYSTEM, APPARATUS, AND METHOD FOR PROTECTION AND CLEANING OF EXHAUST GAS SENSORS

CROSS-REFERENCE TO RELATED APPLICATIONS

This application is continuation of PCT Application No. PCT/US2019/037457, filed Jun. 17, 2019, which claims the benefit of the filing date of U.S. Provisional Application Ser. No. 62/686,237 filed on Jun. 18, 2018, each of which are incorporated herein by reference in their entirety.

BACKGROUND

The present disclosure relates generally to internal combustion engines, and more specifically to sensors in exhaust gas conduits of internal combustion engines. In particular, the disclosure relates to a system, apparatus, and method for preventing the accumulation of particulate matter such as combustion soot on sensors associated with exhaust gas regeneration systems and exhaust gas aftertreatment systems, and for removing accumulated soot from such sensors.

During normal operation of an internal combustion engine, one or more sensors disposed in an exhaust gas flow, such as in an exhaust gas aftertreatment system or an exhaust gas regeneration system, may accumulate particulate matter, such as combustion soot or ash, thereon from the exhaust gas produced by the engine. Most sensors are not well adapted to operate in harsh environments with high concentrations of particulate materials, especially soot and ash. This is evident from the market trends in automotive sensors which show that there are no open-element sensors that are mounted directly into the exhaust stream of diesel engines. There is also a possibility of accumulated particulate matter blocking a stand-off or bypass channel for certain types of sensors which rely on flow of exhaust gas through the stand-off or bypass channel to conduct the measurement. Additional problems occur with respect to soot accumulating on sensors during engine operation, and then hardening after engine operation has ceased, due to condensation and other factors occurring after the engine is shut down, such as the reduction of the elevated temperature experienced during engine operation. This may lead to a constant non-zero output of the sensor.

It is desirable to protect the sensors from accumulation of the combustion soot and ash, and to clean the particulate matter from such one or more sensors from time to time to maintain the accuracy of their readings. Because the sensors are exposed to harsh environments including high temperatures and high concentrations of corrosive compounds and particulate matter, and current sensor technology may exhibit poor performance and short useful life in such harsh conditions, improvements are needed in protecting and cleaning the sensors.

SUMMARY

Disclosed are a system, apparatus and method for protection and cleaning of exhaust gas sensors. The inventors contemplate that the embodiments of the systems, apparatus, and methods herein may each be employed separately, or in combination. Any of the embodiments herein may preferably be employed to prevent accumulation of soot on the sensor, to remove accumulated soot from sensor, and/or to accomplish both prevention and removal.

It is understood that the views are not to scale, are representative only, and may show only one example among a number of possible arrangements of the disclosed components.

DETAILED DESCRIPTION

Figure 1:
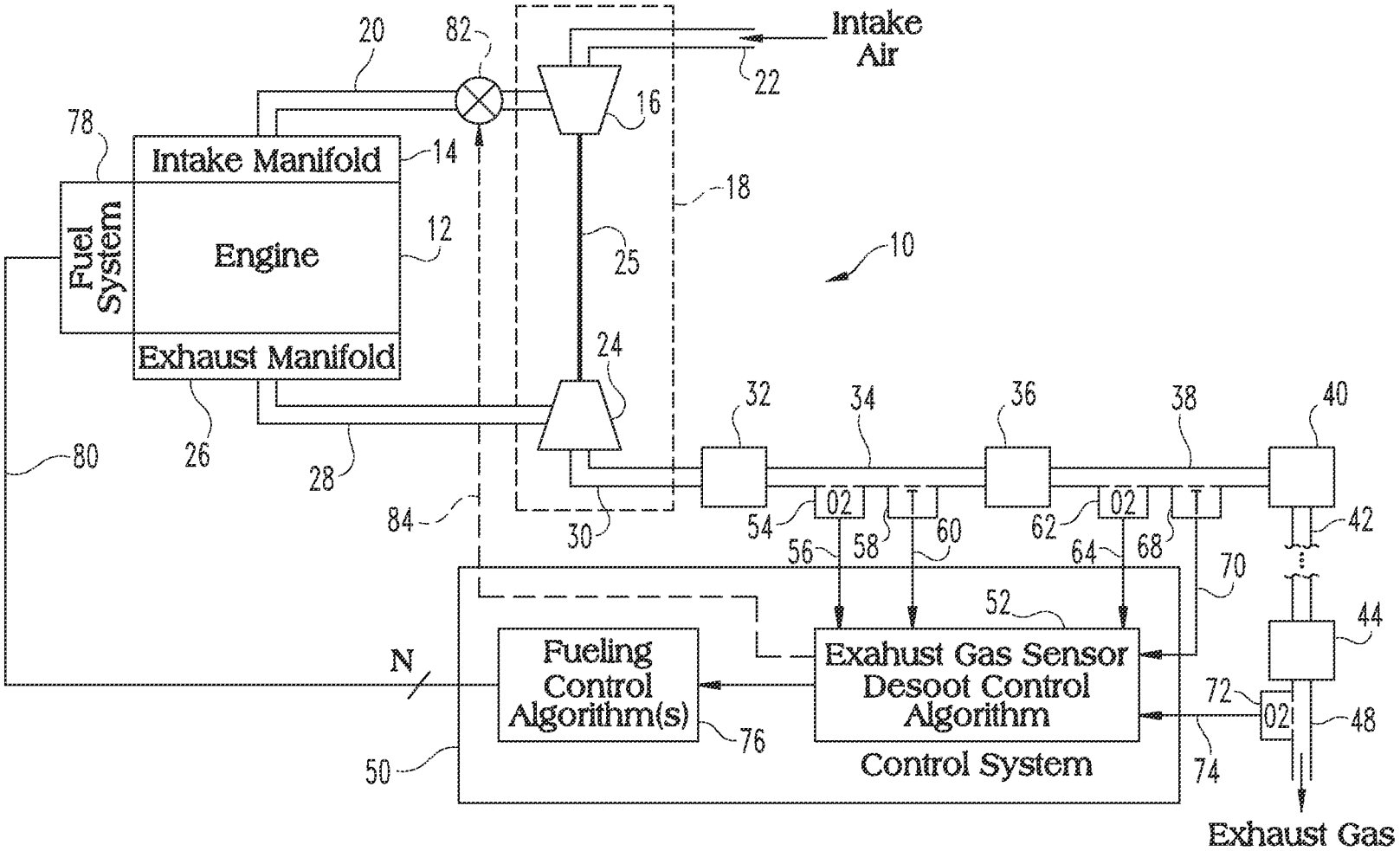
FIG. 1 is a schematic representation of an embodiment of a system for protection and cleaning of exhaust gas sensors.

FIG. 1 is a block diagram of one illustrative embodiment of an internal combustion engine system 10 in which the disclosure may be employed for cleaning combustion soot from one or more exhaust gas aftertreatment sensors, or for protecting the sensors from accumulation of soot. The system 10 includes an internal combustion engine 12 having cylinders in which fuel is combusted in an internal combustion process. The engine 12 may include an intake manifold 14 for introduction of ambient air into cylinders, and an exhaust manifold 26 for collection and release of exhaust gases resulting from combustion of fuel in the engine. Ambient air may enter the engine via a fresh a fresh air intake conduit 22.

Optionally, the engine system 10 may include a turbocharger 18 having a compressor 16 disposed between the fresh air conduit 22 and a second intake air conduit portion 20 that is fluidly connected to the intake manifold 14 to provide intake air to the engine 12. A turbine 24 of the turbocharger 18 may be mechanically coupled via a rotational drive shaft 25 to the compressor 16 in a conventional manner. An exhaust gas inlet of the turbine 24 may be fluidly coupled to an exhaust manifold 26 of the engine 12 via an exhaust gas conduit 28. An exhaust gas conduit portion 30 may be disposed downstream of the turbine 24. The turbocharger 18 may be included in some embodiments of the system 10 and may be omitted in other embodiments, and is accordingly illustrated in FIG. 1 as an optional component of the system 10 as indicated by the dashed-line enclosure surrounding the turbocharger 18.

The system 10 may include an exhaust gas aftertreatment system, including any number of exhaust gas aftertreatment components disposed downstream of the exhaust manifold 26 and upstream of an exhaust gas outlet 48 of the engine system 10. In the embodiment illustrated in FIG. 1, the exhaust gas aftertreatment system includes four exhaust gas aftertreatment components 32, 36, 40, and 44. Examples of exhaust gas aftertreatment components may include, but are not limited to, an oxidation catalyst, a NOx adsorber catalyst, a particulate filter, or other conventional catalysts, filters, or devices for the aftertreatment of exhaust gas. The exhaust gas aftertreatment components may each be or include any conventional exhaust gas aftertreatment components, and components may be alike or different in their constructions and/or functions.

In the embodiment illustrated in FIG. 1, the exhaust gas emitted from cylinders of the engine 12 flows to the exhaust manifold 26, and then flows through the exhaust gas conduit portion 28 to conduit portion 30. The exhaust gas flows through conduit portion 30 to a first aftertreatment component 32, and then may flow through another exhaust gas conduit portion 34 which is fluidly connected to a second aftertreatment component 36 positioned downstream of the first aftertreatment component 32. Another conduit portion 38 extends downstream to direct exhaust gas flow to a third aftertreatment component 40. Exhaust gas flow may continue through another conduit portion 42 to a fourth aftertreatment component 44, and then to the exhaust gas outlet 48 to ambient.

The system 10 further includes a control system 50 that is configured to control operation of components of the system 10. In one embodiment, the control system 50 may be a microprocessor-based control system typically referred to as an electronic or engine control module (ECM), or electronic or engine control unit (ECU). It will be understood, however, that the control system 50 may generally be or include one or more general purpose or application-specific controllers or circuits that are arranged and operable as will be described hereinafter. The control system 50 includes, or is coupled to, a memory unit that has stored therein a number of engine operation parameter settings and software algorithms executable by modules or units of the control system 50 to control various operations of the system 10, including operation of the engine 12.

One such algorithm 52 receives a number of signals from sensors associated with the exhaust gas aftertreatment system, and that produces one or more outputs to control one or more actuators associated with the operation of various components of the system 10. In this regard, the exhaust gas aftertreatment system comprising the components 32, 36, 40, and 44 includes a number of sensors positioned in fluid communication with various ones of the exhaust gas conduits 34, 38, and 48.

In the illustrated embodiment, for example, one of the sensors may be comprised of a conventional oxygen (O2) sensor 54 positioned in fluid communication with the exhaust gas conduit portion 34, and electrically connected to the control system 50 via a signal path 56. The oxygen sensor 54 is configured to sense an oxygen concentration and produce a signal via signal path 56 that is indicative of the concentration of oxygen in the exhaust gas exiting the outlet of the first aftertreatment component 32 and entering the exhaust gas inlet of the second aftertreatment component 36.

Also as exemplified in the illustration of FIG. 1, another sensor may be comprised of a conventional temperature (T) sensor 58 that may be positioned in fluid communication with the exhaust gas conduit portion 34, and may be electrically connected to the control system 50 via a signal path 60. The temperature sensor 58 senses temperature of the exhaust gas in the area of the sensor 58, and is configured to produce a signal that is indicative of the temperature of exhaust gas in that position.

As exemplified in FIG. 1, another sensor comprised of a conventional oxygen sensor 62 may be positioned in fluid communication with the exhaust gas conduit portion 38, and may be electrically connected to the control system 50 via a signal path 64. The oxygen sensor 62 is configured to produce a signal that is indicative of the concentration of oxygen in the exhaust gas exiting the aftertreatment component 36 and entering the exhaust gas inlet of the second aftertreatment component 40.

Also illustrated in FIG. 1 is another sensor comprised of a conventional temperature sensor 68 that may be positioned in fluid communication with the exhaust gas conduit portion 38, and may be electrically connected to the control system 50 via a signal path 70. The temperature sensor 68 is configured to produce a signal that is indicative of the temperature of exhaust gas in the position of the sensor 68, upstream of the aftertreatment component 40.

As exemplified, another sensor may be a conventional oxygen sensor 72 positioned in fluid communication with the exhaust gas conduit portion 48, and electrically connected to the control system 50 via a signal path 74. The oxygen sensor 72 is configured to produce a signal that is indicative of the concentration of oxygen in the exhaust gas exiting the last aftertreatment component 44.

Although FIG. 1 depicts the specific examples of oxygen sensors 54, 62, and 72, and temperature sensors 58 and 68, it may be appreciated that these are merely examples of sensor types. Sensor types may include sensors that detect levels of a number of different characteristics or components of exhaust gas, as well as conditions in the exhaust gas or in the aftertreatment system, such as sensors that detect temperature levels, density or pressure levels, exhaust gas flow rates (such as mass air flow, MAF), or other conditions. The sensors may be disposed in different arrangements than those depicted, and the sensors employed in different embodiments may be alike or different in their constructions and/or functions.

The signals produced by each of the sensors 54, 58, 62, 68 and 72 are provided as inputs to the control system 50. Specifically, the sensor signals may be provided as inputs to an exhaust gas sensor desoot control algorithm 52 of the control system 50 as illustrated in FIG. 1.

The control system 50 may include hardware and software components incorporating a memory unit that may have stored therein means for executing algorithms for determining, generating, and conveying control signals to control various engine operating conditions and parameters. The control system 50 may include a number of algorithms that control one or more engine operating conditions. For example, as depicted in FIG. 1, a set of one or more fueling control algorithms 76 that is responsive to a number of engine operating conditions, such as engine speed and other operating conditions, may determine, generate, and output appropriate fueling commands to the fuel system 78 of the engine 12 in a conventional manner. In the depicted example, one of the fueling control algorithms 76 may receive, as one of its inputs, an output from the exhaust gas sensor desoot control algorithm 52, the details of which will be described in greater detail hereinafter. In any case, a conventional electronically controlled fuel system 78 is operatively coupled to the engine 12, and is electrically connected to the control system 50 via a number, N, of signal paths 80. The fueling commands produced by the one or more fueling control algorithms 76 are provided to the fuel system 78 via a number, N, of signal paths 80 to control the fuel system 78 in a conventional manner to supply fuel to the cylinders of the engine 12.

In some embodiments of the system 10, as shown by dashed-line representation in FIG. 1, a conventional intake air throttle 82 may be disposed in-line with the fresh air intake conduit 20 and electrically connected to the control system 50 via a signal path 84. In such embodiments, the memory unit of the control system 50 may have stored therein one or more conventional algorithms that produce a control signal on the signal path 84 to control the operation of the intake air throttle 82 in a conventional manner to selectively control the flow of fresh air to the intake manifold 14 of the engine 12. In embodiments of the system 10 that include the intake air throttle 82, the exhaust gas sensor desoot control algorithm may produce the control signal on the signal path 84, or may alternatively produce a signal or value from which the control signal provided on the signal path 84 is derived, to selectively control the flow of fresh air to the intake manifold 14.

The control system 50 is operable in a conventional manner to control the air-to-fuel ratio (A/F) supplied to the cylinders of the engine 12. In embodiments of the system 10 that do not include the intake air throttle 82, the control system 50 is operable in a conventional manner to control A/F principally by controlling fueling of the engine 12, via control of the fuel system 78 as described above, for a given, e.g., measured, mass flow rate of fresh air supplied to the intake manifold 14 via the intake air conduit 20. In embodiments of the system 10 that include the intake air throttle 82, the control system 50 may be operable in a conventional manner to control A/F by controlling fueling, via control of the fuel system 78, and/or by controlling the mass flow rate of fresh air supplied to the intake manifold 14, via control of the intake air throttle 82.

An increase in exhaust gas temperature may be commanded by the control system in order to burn off soot accumulations in the aftertreatment system. For example, as depicted in FIG. 1, an aftertreatment component 32 constituted as an oxidation catalyst may include a conventional catalyst element that is responsive to hydrocarbons introduced into the exhaust gas stream at a location upstream of the oxidation catalyst 32 to elevate the temperature of the exhaust gas exiting the oxidation catalyst 32 along conduit portion 34. Hydrocarbons may be introduced into the exhaust gas stream by a number of conventional techniques including, for example, introducing additional fuel into the cylinders of the engine 12 at or near the end of, and/or after, combustion of a main quantity of fuel during each engine cycle or periodically over a number of engine cycles. In this way, hydrocarbons may be controllably introduced into the exhaust stream to increase the temperature of the exhaust gas exiting the oxidation catalyst 32 to a temperature or temperature range suitable for regeneration of one or more parts or components of the aftertreatment system that are downstream of the oxidation catalyst.

It may be appreciated that sensors disposed in the aftertreatment system are exposed to harsh conditions and to accumulation of particulate matter due to their positions along the exhaust gas stream in system 10. The inventors have developed systems, devices, and methods to prevent accumulation of particulate matter on sensors in the system and to remove accumulated particulate matter on the sensors.

Figure 2:
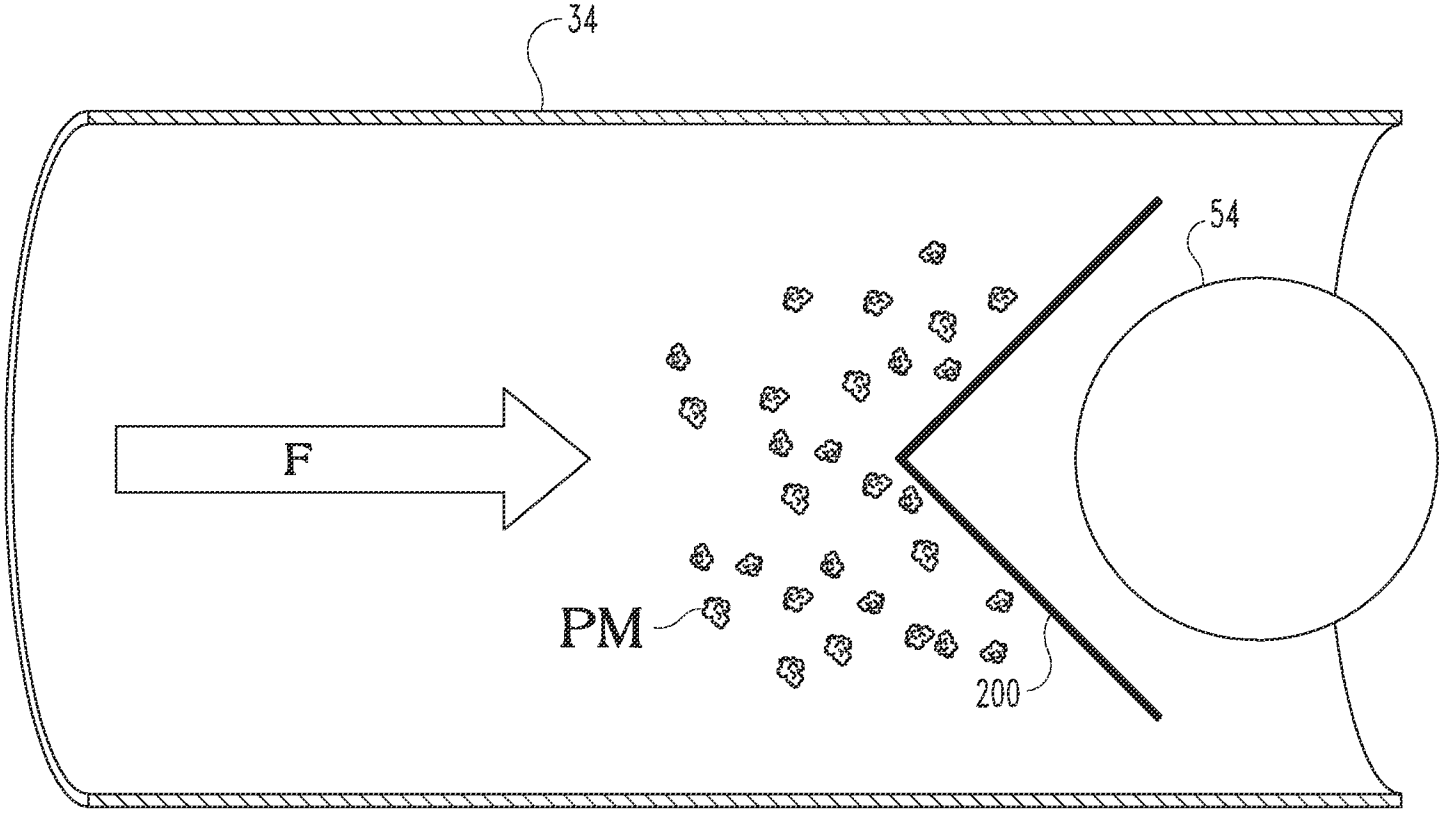
FIG. 2 is a schematic representation of a portion of an exhaust gas conduit including an illustrative embodiment of a sensor protection arrangement.

FIG. 2 is a schematic depiction of a soot deflector according to an embodiment of the disclosure. In order to protect the sensing element from soot accumulation, the inventors have determined that a soot deflector positioned upstream of a sensing element in the exhaust gas flow direction may deflect most of the particulate matter, such as soot or ash, away from the sensor. The schematic depiction of FIG. 2 shows a sensor 54 or a sensing element of such sensor and a shield element 200 disposed in the exhaust gas conduit portion 34 upstream of the sensor 54 to provide a physical barrier at least partially preventing impingement of oncoming particulate matter PM upon the sensor 54. The shield element 200 is affixed at one or more of its sides to an inner surface of the exhaust gas conduit portion 34, and is positioned upstream of the sensor with respect to the direction of flow F of the exhaust gas stream.

The shield element 200 of FIG. 2 preferably may be comprised or formed of a ceramic material or other suitable material for deflecting particulate matter and for withstanding system operating conditions including extreme temperatures, chemical components of engine exhaust gas, and vibrations. The surface of this shield element 200 may preferably be coated with Teflon or other suitable material that does not allow the oncoming soot to adhere to the surface of the shield element 200. For example, an oleophobic or hydrophobic layer compatible with the harsh conditions of diesel exhaust gas flow may be selected. The shield material preferably has been selected as the result of accelerated life testing (ALT) to ensure that the shield material can withstand vibrations experienced under system operating conditions without cracking during its life cycle. In an embodiment, the shield element has at least one surface oriented toward the direction of oncoming exhaust gas flow that is positioned at an angle with respect to the flow direction F so as to deflect incoming particulate matter PM away from the sensor 54.

FIG. 2 shows a specific example of a sensor 54 positioned in a conduit portion 34, which corresponds to a portion of the system configuration depicted in FIG. 1. Other examples of soot protection devices, means, and methods according to the disclosure also are depicted herein in FIGS. 2-9 as exemplary sensors labeled as sensor 54 installed in conduit portion 34. However, the inventors contemplate use of the soot protection devices, means, and methods disclosed herein for any sensor positioned along any portion of an engine system 10 through which exhaust gas may flow. Such portions include, in particular, all parts of the exhaust system, the aftertreatment system, and the exhaust gas recirculation (EGR) system.

Figure 3:
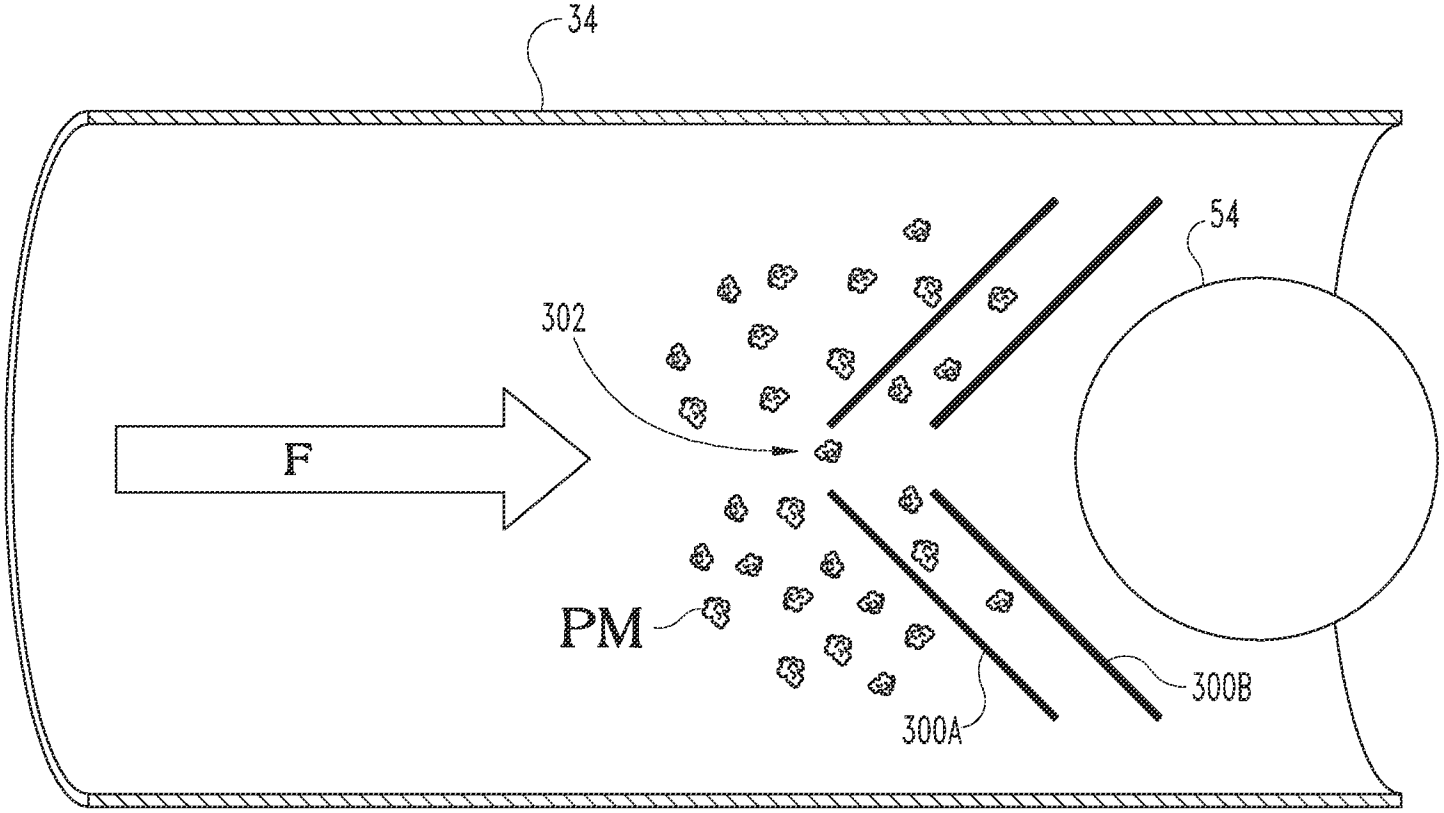
FIG. 3 is a schematic representation of a portion of an exhaust gas conduit including another illustrative embodiment of a sensor protection arrangement.

FIG. 3 is a schematic depiction of a soot deflector according to another embodiment of the disclosure. In this embodiment, the soot deflector comprises a plurality of shield portions. Here, shield portions 300A, 300B are positioned upstream of a sensing element of a sensor 54 in the exhaust gas flow direction F. The plurality of shield portions are disposed in the conduit portion 34 in positions spaced apart from one another in a longitudinal direction along the direction of flow F of the exhaust gas stream and may be affixed to an inner wall of the conduit portion 34. In an embodiment, the plurality of shield elements 300A, 300B are positioned to leave open an aperture 302 to allow flow of exhaust gas within the conduit portion 34. The example of FIG. 3 shows the plurality of shield elements 300A and 300B in a dual-baffle arrangement positioned upstream of the sensor 54, providing a physical barrier at least partially preventing impingement of oncoming particulate matter PM upon the sensor 54.

The plurality of shield elements 300A, 300B of FIG. 3, similarly to that of the configuration of FIG. 2, preferably may be comprised or formed of a ceramic material or other suitable material for system operating conditions. The surface of this plurality of shield elements 300A, 300B may preferably be coated with Teflon or a suitable material that does not allow the oncoming soot to adhere on the surface of the plurality of elements 300A, 300B, and otherwise may be formed or coated with materials as described above with respect to FIG. 2.

Figure 4:
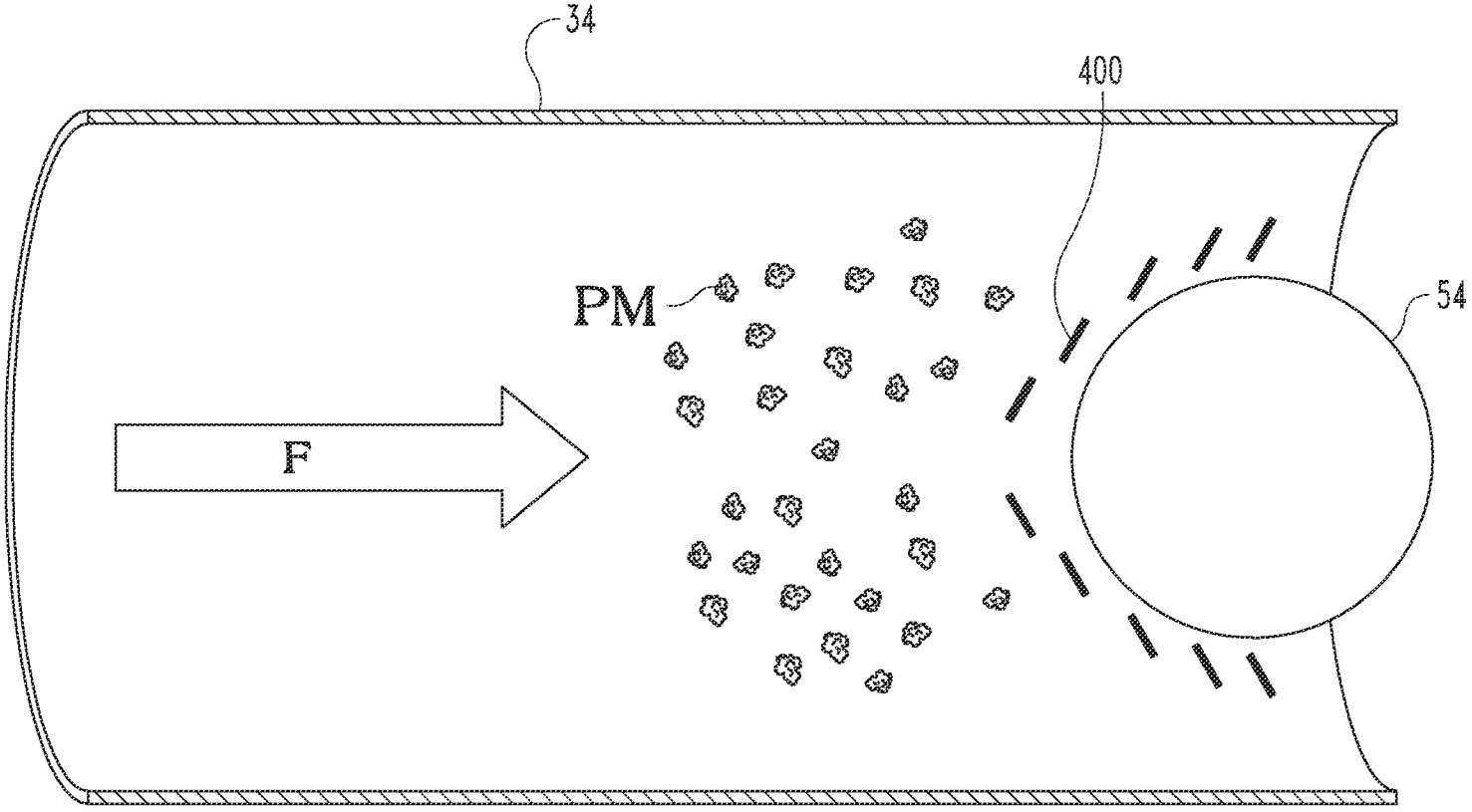
FIG. 4 is a schematic representation of a portion of an exhaust gas conduit including another illustrative embodiment of a sensor protection arrangement.

FIG. 4 is a schematic depiction of a soot deflector 400 according to another embodiment of the disclosure. In an embodiment, the soot deflector 400 has a construction similar to that of the deflector of FIG. 2 above, but is comprised of a perforated material so that the deflector 400 includes apertures or perforations through which exhaust gas may flow. The non-perforated portions of the soot deflector surface deflect particulate matter and thus keep at least part of the particulate matter in the exhaust gas flow F from reaching the surfaces of the sensor 54. In another embodiment, the soot deflector 400 may be constructed as a part of the housing of the sensor itself. In this latter embodiment, the soot deflector 400 constitutes a second, perforated outer housing layer of the sensor 54. In either embodiment, the sensor and/or the shield element may be affixed to an inner wall of a conduit portion 34. Similarly to the embodiment described above with respect to FIG. 2, the embodiment of FIG. 4 also preferably may be comprised or formed of a ceramic material or other suitable material. The surface of the deflector 400 may preferably be coated with Teflon or a suitable material that does not allow the oncoming soot to adhere on the surface of the deflector 400.

Figure 5:
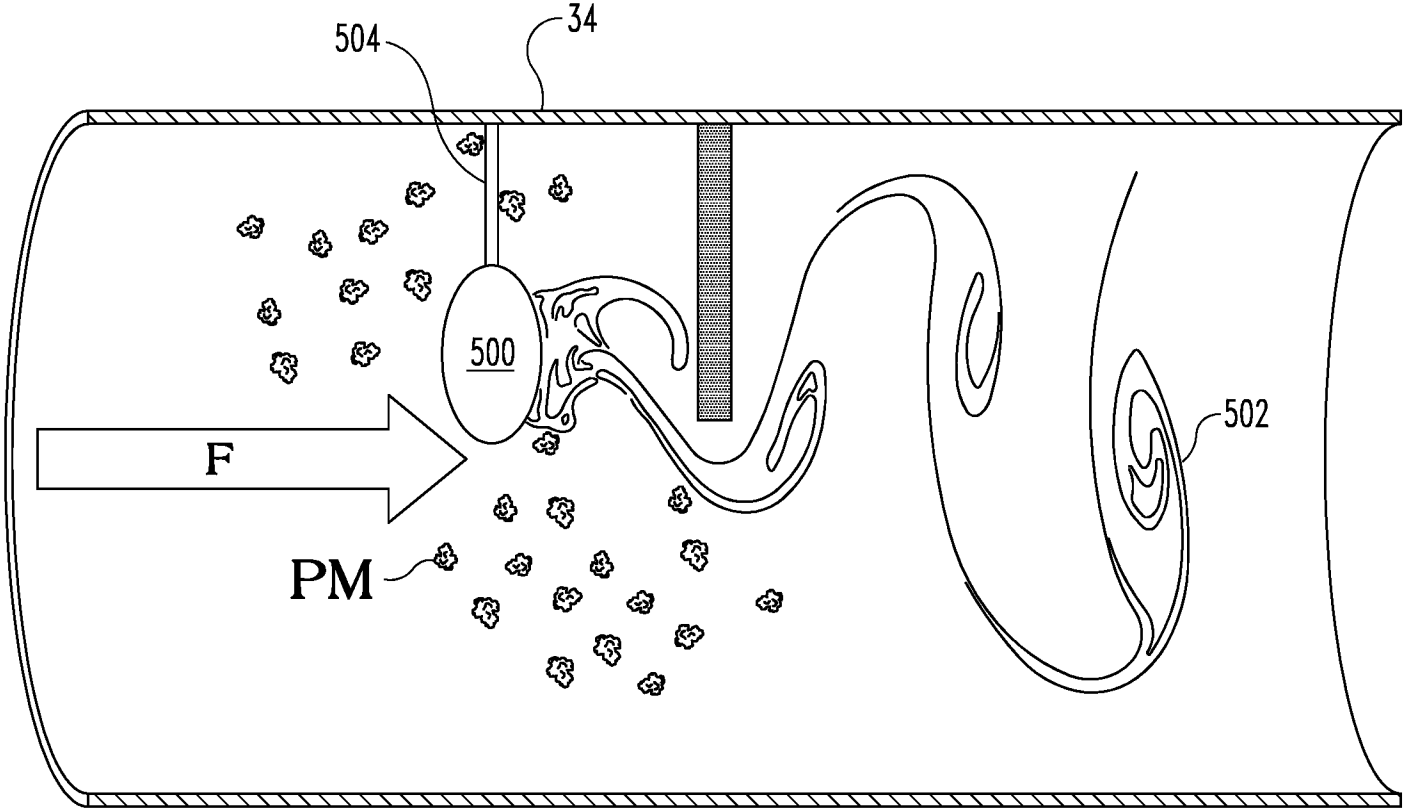
FIG. 5 is a schematic representation of a portion of an exhaust gas conduit including another illustrative embodiment of a sensor protection arrangement.

FIG. 5 is a diagram of an illustrative embodiment of the disclosure wherein a bluff body is positioned upstream of the sensor in the exhaust gas stream in an exhaust gas conduit, for example sensor 54 in conduit 34 as arranged in FIG. 1. The bluff body 500 is positioned upstream of the sensor 54 in the direction of flow F, such that a von Kármán vortex street is created downstream of the bluff body 500 and in the vicinity of sensor 54. As depicted in FIG. 5, the bluff body may extend into the cavity of the conduit portion 34, and an affixation means such as a rod 504 affixed between the bluff body and an inner wall of the conduit 34 may extend between the bluff body and the inner wall. The bluff body may be formed as, for example, a sphere, or may be in the form of a cylinder that extends outwardly from the inner wall into the cavity.

Eddies are shed continuously from each side of the bluff body leading to the generation or formation of vortices 502, and resulting in formation rows of vortices 502, in the wake of the bluff body 500. The alternation leads to the core of a vortex in one row being opposite the point midway between two vortex cores in the opposite row. When a single vortex is shed, an asymmetrical flow pattern forms around an object positioned within the flow downstream of the bluff body. The pattern changes the pressure distribution around the object. Accordingly, the alternate shedding of vortices on or in the vicinity of the object can create periodic lateral (sideways) forces on the object, in this case, a body of a sensor 54. The forces may cause the body to vibrate. Ultimately, the energy of the vortices which sets up vibrations of the body of the sensor 54 causes the deposited soot to be shaken off and carried away by the flow. As the vortices move further downstream, the remaining energy is consumed by viscosity and the regular pattern disappears.

Similarly to the embodiment described above with respect to FIG. 2, the embodiment of FIG. 5 also preferably may be comprised or formed of a ceramic material or other suitable material. The surface of the deflector may preferably be coated with Teflon or a suitable material that does not allow the oncoming soot to adhere on the surface of the deflector.

Figure 6:
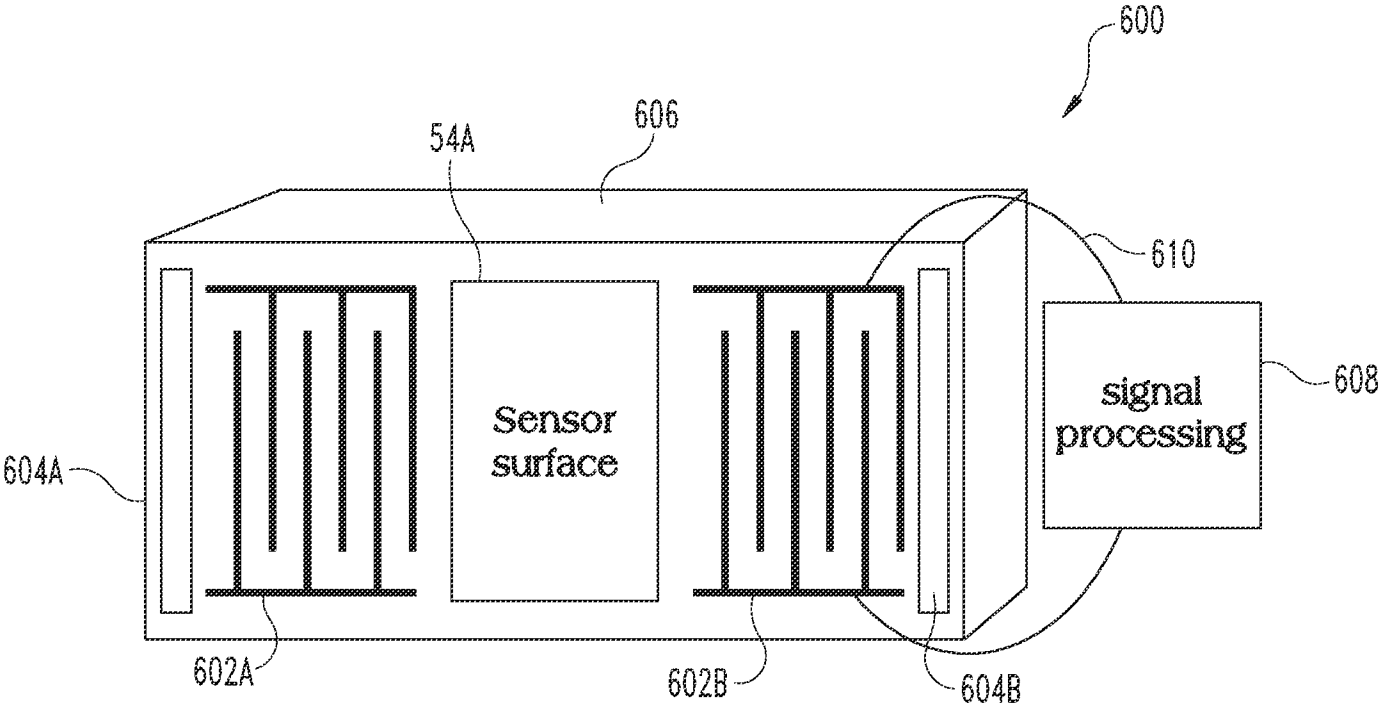
FIG. 6 is a schematic representation of another illustrative embodiment of a sensor protection arrangement.

In an embodiment of the disclosure, the sensor, or a sensing system incorporating the sensor, may include a surface acoustic wave-based ultrasonic soot detection, measurement, and/or cleaning apparatus or process. FIG. 6 is a schematic diagram of an illustrative embodiment of a surface acoustic wave (SAW) based system 600 according to the disclosure. The system 600 may be disposed in the exhaust gas stream of the system 10. As illustrated in FIG. 6, the SAW system 600 may comprise interdigital transducers (IDTs) 602A, 602B positioned on either side of the surface 54A of the sensing element of the sensor 54. In an embodiment, a first IDT 602A may generate or propagate a SAW based on an electrical impulse signal generated by a control system of the system 10, and received by the IDT 602A. The SAW may propagate across a sensor surface 54A, which may be disposed along a surface of a piezoelectric substrate 606. The SAW may be detected by a second IDT 602B. Conversely, the system 600 may be constituted such that the second IDT 602B propagates SAWs and the first IDT 602A receives the SAWs. Acoustic absorbers 604A, 604B may be disposed on the device to reflect SAWs. The receiving IDT generates electrical signals based on the SAWs received. In the example of FIG. 6, the receiving IDT 602B may generate an electrical signal based on the SAWs received, and may communicate the signal to an element of a controller 50 of the engine system. In particular, the controller may comprise a signal processing module 608 that may employ algorithms to determine or estimate a value for an amount of soot accumulation. The determination or estimation may be based on the values for velocity or other characteristics of the SAWs received, which are reflected in the signal conveyed to the module 608 via wired or wireless communication means 610 such as a wired connection between IDT 602B and the module 608.

The accumulation of soot particles on the SAW device will affect the surface acoustic wave as it travels across the delay line. The velocity v of a wave traveling through a solid is proportional to the square root of product of the Young's modulus E and the density rho of the material.

$$v \propto \sqrt{E/\rho}$$

Therefore, the wave velocity will decrease with added soot mass. This change can be measured by a change in time-delay or phase-shift between input and output signals, resulting in a determination or estimation of a value of an amount of soot accumulation. Signal attenuation could be measured as well, as the coupling with the additional surface mass will reduce the wave energy. In an example, a comparison of a measured value of the IDT-generated electrical signal to a reference value, for example, a comparison in value showing a shift in resonance frequency between the IDTs, may indicate a level of soot accumulation on the surface 54A of FIG. 6.

In the case of soot mass-sensing, as the change in the signal will always be due to an increase in mass from a reference signal of zero additional mass, signal attenuation can be effectively used to determine or estimate a value for the mass. Thus the SAW system may be used to detect the presence of soot deposits, or to determine or estimate values of levels of soot accumulation on the sensor. The values may be interpreted by module 608 and used as an input for controlling regeneration events of the sensor system. A comparison of a measured value of the IDT-generated electrical signal to a reference value, for example, a comparison in value showing a shift in resonance frequency between the IDTs, may indicate a level of soot accumulation on the surface 54A.

Once a value of a mass of soot accumulated has reached a critical threshold value, regeneration can be triggered. In an embodiment, a control algorithm for the sensor system will accept and interpret a signal indicating a value of a mass of accumulated soot on the sensor and the value will be used as an input triggering a regeneration or cleaning event. Because the SAW wave velocity is dependent on the mass of the soot accumulated, after every cleaning cycle, a velocity measurement may be derived and the cleaning cycle may be repeated until the mass of soot deposited drops below a critical value beyond which there is no effect of the remaining soot on the measurement capabilities of the device.

In an embodiment, the regeneration trigger may start an active regeneration event, including, for example, increasing temperature of the sensor as further described below, to burn off accumulated soot particles.

In addition to the determination or estimation of an amount of soot accumulation on the sensor, the SAW device 600 also may be employed for removal of soot accumulation in embodiments of the apparatus, system, or method. Physical vibrations resulting from transit of the surface waves of different frequencies propagated by the SAW device 600 may be employed to shake accumulated soot off of the sensor surface 54A. The device 600 may be configured to act as a resonator, oscillating at greater amplitudes at some wave frequencies, to aid in dislodging soot particles from the surface 54A of the sensor 54.

Figure 7:
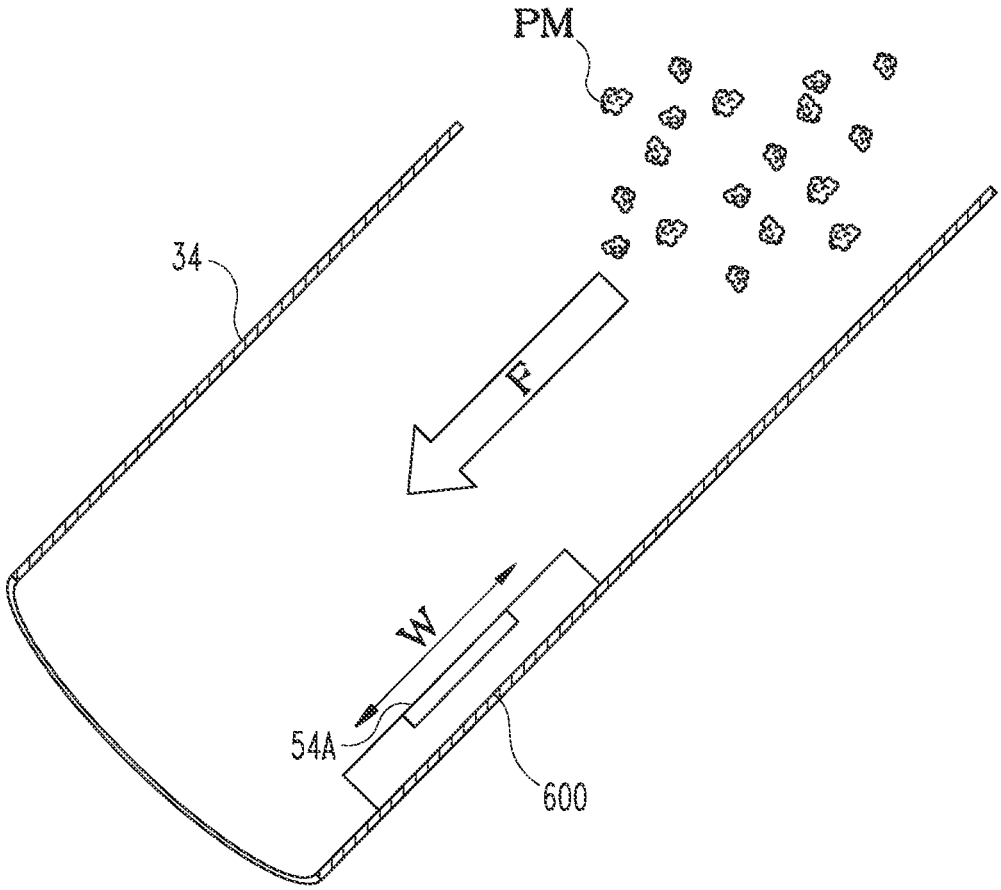
FIG. 7 is a schematic representation of a portion of an exhaust gas conduit including another illustrative embodiment of a sensor protection arrangement.

FIG. 7 illustrates an exemplary embodiment of a SAW system 600 of a type shown in FIG. 6 disposed in exhaust gas flow F in an exhaust gas conduit portion 34. As illustrated, SAWs may be propagated across a surface 54A of a sensor 54 disposed in the exhaust gas stream. The system 600 may be affixed to an inner wall of the conduit portion 34. In an embodiment as shown in FIG. 7, SAWs are propagated by IDTs in two directions represented by double arrow W. This schematic representation is not to scale.

Figure 8:
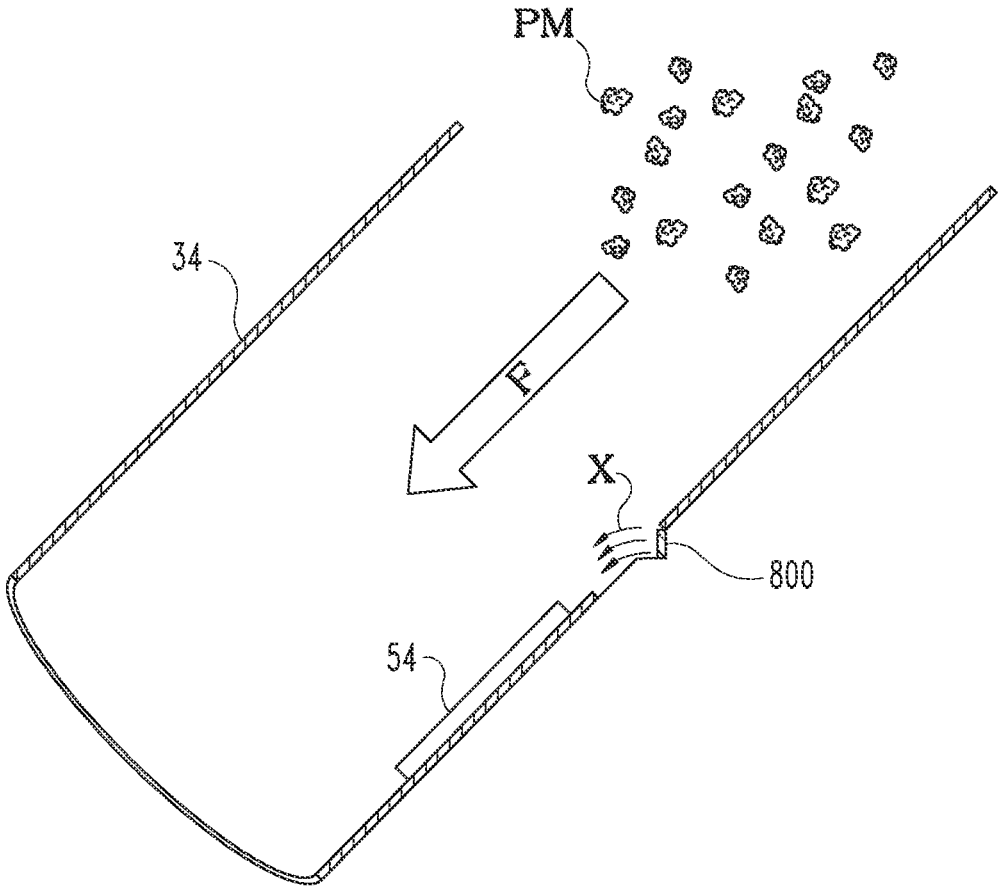
FIG. 8 is a schematic representation of a portion of an exhaust gas conduit including another illustrative embodiment of a sensor protection arrangement.

FIG. 8 is a diagram of an illustrative embodiment of the disclosure including an actuator that generates ultrasonic waves by directing bursts of pressurized gas into the cavity of the exhaust gas conduit. As seen in FIG. 8, the actuator may be constituted as a blower or injector 800 that injects pressurized bursts of gas into the exhaust gas conduit portion 34. The injector 800 may be positioned at a location upstream of the sensor 54 with respect to the direction of exhaust gas flow F, and is positioned in close proximity to the sensor 54. The bursts of pressurized gas may be aimed in a direction that is at an angle to the surface of the sensor 54. In the example of FIG. 8, the direction X is represented by three arrows, and the angle between the direction X and the sensing element surface of the sensor 54 is approximately 30 degrees. In this manner, the bursts of pressurized gas may be directed toward the vicinity of the sensor 54 or to a position near the sensor 54 but the bursts are not directed aimed at the surface of the sensor to be cleaned.

The pressurized gas may be injected in separate bursts generated at high frequencies (bursts/unit of time). The high frequency bursts may thus energize a boundary layer of exhaust gas near the sensor 54. Accordingly, the high frequency bursts may generate mechanical vibrations or ultrasonic waves that impinge and act upon the surface of the sensor 54. The vibrations or waves tend to prevent deposition of soot, or to dislodge deposited soot, by imparting a vibrational force on the surface of the sensor that causes soot particles to have reduced adherence to the surface of the sensor. Vibrational energy is provided to the sensor 54 without positioning the sensor directly on an actuator. This embodiment may reduce the amount of unwanted noise in the sensor readings that would be caused by positioning the sensor directly on an actuator or in close proximity to an actuator. Because the ultrasonic waves generated through use of the injector 800 are at a high frequency as compared to waves generated by the passage of the exhaust gas flow F past the sensor 54, the embodiment may be employed for sensor cleaning while also minimizing unwanted disturbance (noise) in the measurements being taken by the sensor 54.

Figure 9:
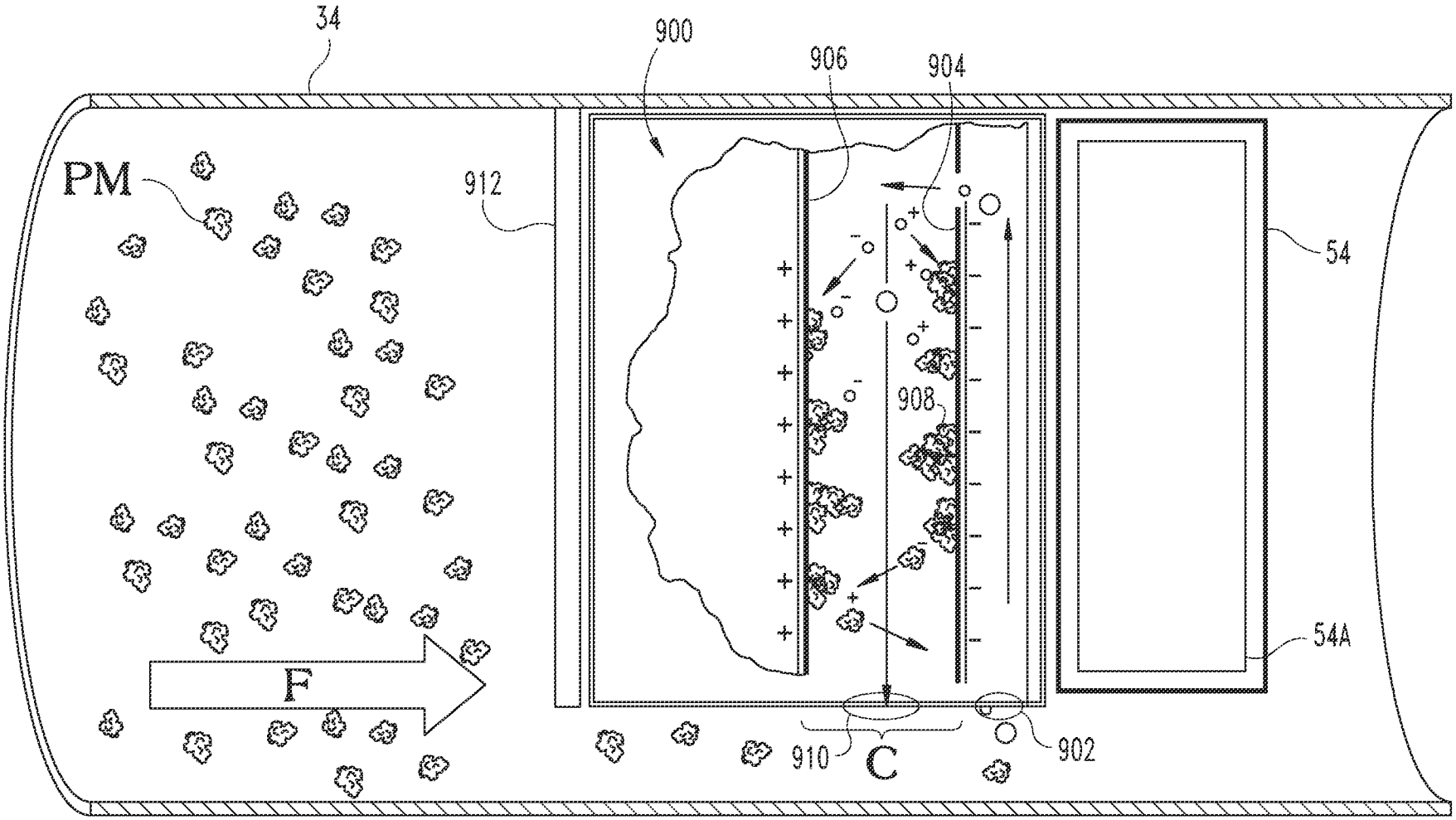
FIG. 9 is a schematic representation of a portion of an exhaust gas conduit including another illustrative embodiment of a sensor protection arrangement.

FIG. 9 is a schematic representation of an illustrative embodiment of the disclosure including a particle charging system and method for trapping soot particles and chemi-ions upstream of the sensor. Exhaust gas flowing through exhaust gas conduit portion 34 containing particulate matter PM or chemi-ions may enter an entry point 902 of a chamber of the particle charging system 900. The charging system 900 may be disposed in a position in the conduit portion 34 upstream of the sensor 54 having a sensor element having surface 54A. The system 900 may be attached to or extend outwardly from an inner wall of the conduit such that the system is disposed in the exhaust gas stream in the cavity of the conduit portion 34. Some particles of soot in the exhaust gas may have an ionic charge prior to entry into the conduit. Other soot particles may enter the charging system 900 uncharged. Circulation of exhaust gas through the chamber may be enhanced by shaping the conduit 34 or the chamber of the system 900 to impel exhaust gas through the chamber, or by other impelling forces such as a fan (not shown).

The charging system 900 of FIG. 9 includes one or more electrodes positioned within the system 900 adjacent to the chamber. The one or more electrodes generate an electrical field in the cavity of the chamber of the charging system 900, such that exhaust gas flow upstream of the sensor 54 is exposed to the electrical field. In an embodiment, the one or more electrodes is a set of electrodes comprising a negative (−) electrode 904 and a positive (+) electrode 906, essentially acting as a capacitor C. One or more of the electrodes may be charged (for example, to 1000V). The electrical field which may impart a positive or negative electrical charge to uncharged particles. The electrical field may cause chemi-ions and other charged particles in the flowing exhaust gas to be attracted to an electrode, or to a substrate or inner wall of the chamber adjacent to the electrode. Size to mass ratio of a given particle and exhaust gas flow velocity may affect the level of attraction of the particle to an electrode. By continued action of the electrical field within the chamber, electrically charged particles may accumulate on the electrode. In this manner, particulate matter PM may be removed from the exhaust gas stream, and exhaust gas with a reduced load of particulate matter may exit the chamber at an exit point 910.

Formations of charged particles attracted to the electrodes may accumulate within the chamber, possibly in dendrite or stalagmite formations 908 as depicted in FIG. 9. Eventually, agglomerated groups of charged particles may break off from the dendrite or stalagmite type formations 908, resulting in fluctuations in current levels in the electrical field. The current fluctuations may be sensed, measured, and communicated in the form of signals to a control system 50 of the system 10 to trigger a light-off condition. In an embodiment, when a balance is established between a rate of deposition of particles in the chamber and a rate of break-off of agglomerated particle masses, a light-off condition may be triggered.

In an embodiment, the accumulated charged particles may be burned off by increasing the temperature in the vicinity of the electrode. A heating element, schematically represented by reference numeral 912 in FIG. 9, may be positioned near the chamber of the system 900, to be used to increase the temperature to achieve burn-off of the accumulated particles. In an embodiment, the heating element comprises platinum as a catalyst to lower the effective burn-off temperature.

It may be appreciated that use of the apparatus, systems, and processes described above may lead an accumulation of soot particles in positions where removal of the particles through a regeneration event such as active or passive burn-off may be desirable. A first example is the burn-off of accumulated charged particles referenced above with regard to the system 900 of FIG. 9. Additional exemplary circumstances may include removal of accumulated particles from crevices near deflecting elements 200, 300A, 300B, or 500 of FIG. 2, 3, or 5; or from perforations in or crevices near deflector 400 of FIG. 4.

In an embodiment of the disclosure, there is provided an apparatus, system, or process to conduct an active regeneration of the sensor or of a sensor protective device by increasing temperature levels to achieve burn-off of accumulated soot. In an embodiment, the temperature is increased by applying heat from a heating element (heating coil) of the sensor or soot control device or system, or otherwise employing operations or apparatus of the overall system 10, in a manner that increases temperature in the vicinity of the accumulated soot particles up to ~600° C. or a level sufficient to achieve burn off of the accumulated soot. A passive heat-based regeneration may also be implemented using the method or system of the disclosure, depending on the scope of the application. A separate platinum (Pt) wire element may be incorporated in the sensor or sensor protection system and used to increase the temperature in the area of accumulation to –300° C., or to a temperature wherein accumulated soot may be oxidized in the presence of Pt operating as a catalyst for oxidation. An illustration of an example of such a Pt based heating element is shown in FIG. 9. The reaction may typically be represented as:

$$NO+\tfrac{1}{2}O_2 \leftrightarrows NO_2$$

$$NO_2+C \rightarrow NO+CO$$

$$NO_2+C \rightarrow \tfrac{1}{2}N_2+CO_2$$

A combination of these two regeneration strategies, high temperature active regeneration and lower temperature Pt-catalyzed regeneration, may be implemented to remove accumulated soot in the vicinity of or on the sensing element of the sensor. The lowering of the burn-off temperature, as in the catalyzed regeneration, can significantly prolong the useful life of the heater and the sensor elements because higher temperatures have been considered to cause degradation of the sensing element and the heater due to thermal fatigue over multiple regeneration cycles.

A benefit of the presence of Pt in the regeneration operation is that additional oxygen is not needed to perform the burn off, due to the presence of Pt. An active regeneration can be performed at ~600° C. and can be triggered when a diesel oxidation catalyst (DOC) is being regenerated, which would aid in lowering potential NOX emissions associated with sensor particulate matter burn-off under lean conditions. A passive regeneration in the presence of Pt (available in the heating element) at ~300° C. have in an embodiment would increase useful life of the sensor due to decrease in peak temperatures involved in the thermal cycling of active regeneration.

In an embodiment, an apparatus, system, or process determines a value for the amount of soot accumulation on the sensor system by measuring the change in resistance of the heating element, and comparing the change with a change in resistance of temperature sensing elements disposed in the region of the sensor. This comparison of relative change in the resistance values may be employed to determine whether a reduction in the baseline resistance level exists, which is independent of the changes due to flow of exhaust gasses. As all elements are connected to a Wheatstone bridge, the change in resistance can be compared with an identical resistor on the bridge which is not an active component of the sensor.

In an embodiment, if the presence of soot has been determined by an operation, for example, by using the SAW based detection and measurement system described previously, a burn-off may be triggered during engine motoring or key off based on the application of the control system. During the regeneration, a virtual sensor or a performance map is used as the reference for the control of the burn-off operation, because the actual sensor will be on downtime. In an embodiment, a process that allows for a decrease of the downtime of the sensor comprises use of two or more heating elements between the temperature sensors, and performing the burn-off in a phased manner, thereby eliminating or reducing the need for downtime to remove accumulated soot. Here, the operation requires computation of the current required to provide sufficient heating for optimal operation of the sensor.

Figure 10:
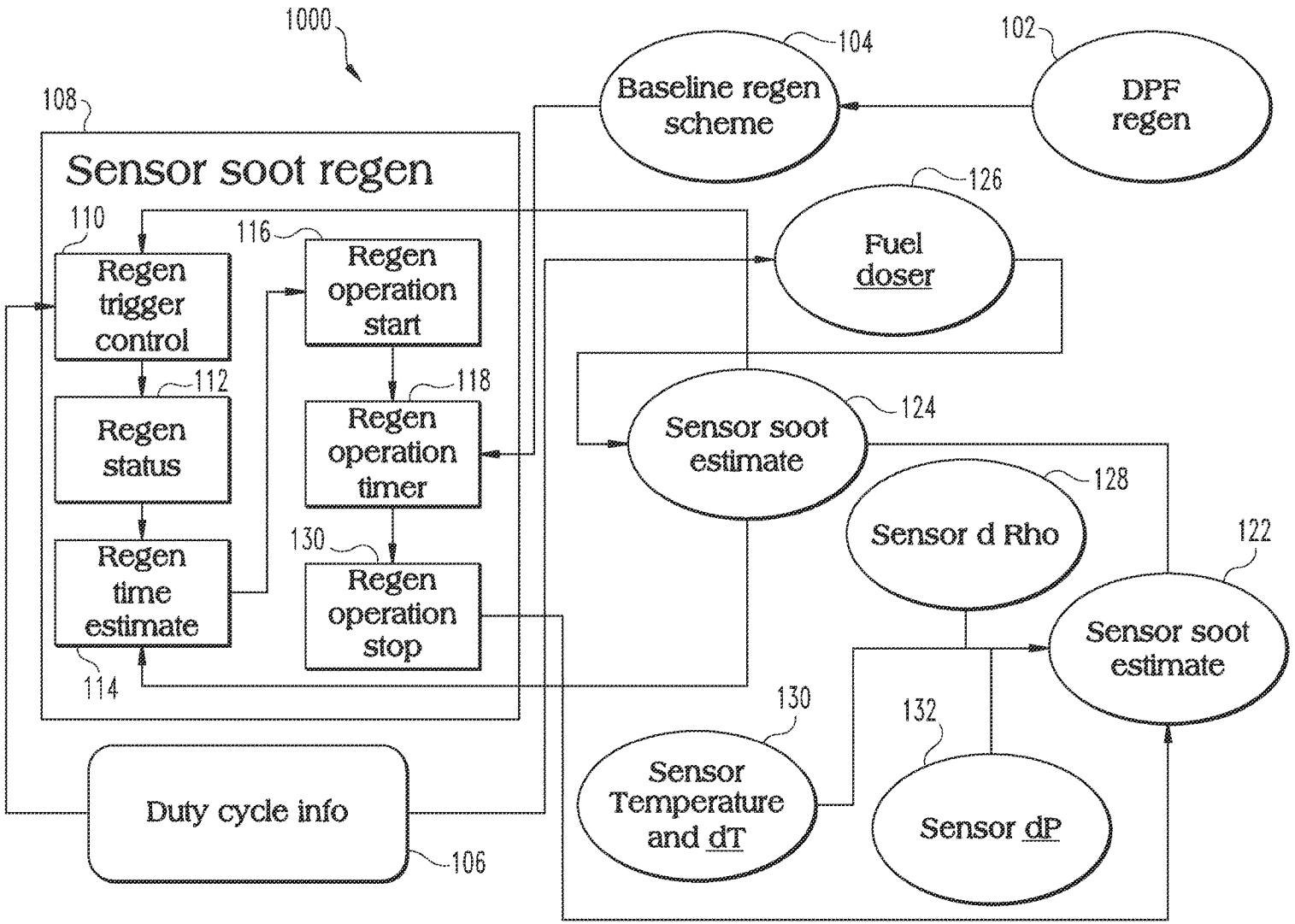
FIG. 10 is a block diagram representing engine components and control steps for a sensor soot regeneration strategy in accord with the disclosure.

FIG. 10 illustrates an embodiment of the disclosure where a system and process are provided for controlling soot buildup on a sensor disposed in an exhaust gas stream in connection with operation of an engine system 10. In the specific example depicted in FIG. 10, a system and process 1000 are provided for adjusting baseline controls for regeneration of a diesel particulate filter (DPF) of an engine system based on determinations showing that a level of soot accumulation on or near a sensor has exceeded a limit. However, other regeneration events relating to other engine aftertreatment and/or EGR components are also contemplated.

In an embodiment of the disclosure as schematically depicted in the diagram of FIG. 10, a system 1000 conducts DPF regeneration events 102 based on a baseline regeneration scheme 104 that is conducted independently of any sensor soot readings. A command based on the baseline scheme 104 is incorporated with engine duty cycle information 106 and the resulting signal is an input to a sensor soot regeneration module represented by element 108. Sensor soot regeneration module 108 includes submodules or subroutines, whose operations may be conducted in a control system 50 of the engine system 10 or a sensor soot regeneration module 108 as a subunit of the control system 50.

The regeneration module 108 may perform an operation to interpret the sensor soot level value or estimate, and to interpret signals indicating a duty cycle condition of the engine system 10. The regeneration trigger control operation 110 may yield a regeneration status condition signal 112 that is communicated for use in a regeneration status operation of the sensor soot regeneration module 108. The regeneration status operation may set a status condition. The status condition may be communicated as a signal for use in a regeneration time estimate operation 114. If the status condition and the time estimate operation conditions are satisfied to trigger a start of a regeneration operation, a regeneration operation start operation 116 will be triggered. Based on a timer operation 118, the regeneration operation may continue for a determined time based on the value of the amount of sensor soot that has been determined or estimated, as well as duty cycle condition information, and other system inputs. Then a regeneration operation stop operation will be conducted 120.

Inputs to the operations of the sensor soot regeneration module may preferably include a sensor soot estimate 124. The sensor soot estimate 124 may be calculated from values obtained from a soot verification operation 122 that determines a level of soot accumulation. Readings from sensors that provide values for estimates or determinations of conditions in and around the respective sensor are collected. Such sensor readings may preferably indicate values for density near the sensor (d Rho) 128, sensor temperature and/or change in temperature (dT) 130, and sensor pressure and/or change in pressure (dP) 132.

In an embodiment, this regeneration event involves altering the air to fuel (A/F or ATF) ratio of the mixture introduced into cylinders of the engine based, in part, upon the amount of soot to be burned off of the sensor. A baseline regeneration scheme 104 is used as the reference for burning the soot off from the sensor. Once the DPF regeneration 102 is triggered, this baseline regeneration scheme 104 may be used to determine the duration of the time span for which the sensor regeneration process will occur, based on a soot amount determination, and other inputs to the control system 50 such as duty cycle information 106. The soot amount determination may be calculated based on inputs including sensor. The inputs may be used to trigger the regeneration controller of the sensor which will elevate the temperature of the heater of the sensor system. Under the presence of Pt, the soot burn off may occur until the end of DPF regeneration event.

An operation to introduce a fuel amount into the exhaust gas stream may be directed by the control system 50 in a signal to a fuel doser 126, in order to implement the sensor regeneration operation. As an end of the determined sensor soot regeneration operation time, the regeneration operation may be stopped by signals from the control system 50, and an operation to conduct an end of regeneration soot verification operation may be directed by the control system 50 to confirm a value for the level of soot present on the sensor post-regeneration.

The soot level estimation or determination may, in an embodiment, be based upon the resistance of individual resistors that make up temperature sensors, which reduces with increase in the accumulation of soot. Since each resistor is operatively connected to a Wheatstone circuit, based on the reference resistance measurement from a resistor in the bridge but not on the sensor, it is possible to determine if the decrease in resistance is due to the accumulation of soot on the sensor. The bridge also enables temperature compensation and can be used to differentiate between a broken sensor and a fully soot laden sensor.

In an embodiment of the sensor soot regeneration system, the regeneration may be conducted in the form of passive regeneration at 300° C. in the presence of Pt under high NOx conditions, such as those that exist in a typical EGR flow. Active regeneration at higher temperatures, e.g., >600° C., may also be used in conjunction with the passive regeneration method, depending on the application. A separate heater coil may be used for HHP applications if required. The OBD system and process are adapted to accommodate and correct for any slip in NOx.

A combination or coordination of these regeneration strategies may be thus implemented to remove any accumulated soot on the sensing element.

This disclosure encompasses using one of the above-described soot protection or cleaning strategies, and also encompasses use of more than one of the above-described soot protection or cleaning strategies in combination.

This disclosure encompasses, in an embodiment, a device for protecting a sensor from particulate matter accumulation in an exhaust gas conduit in an internal combustion engine. The device includes a deflector positioned upstream of the sensor in a direction of oncoming flow of exhaust gas in the conduit. In an embodiment, the deflector includes a first surface positioned at an angle with respect to the direction of oncoming flow to deflect particulate matter in the oncoming flow away from the sensor. In an embodiment, the deflector includes a second surface positioned at an angle to the first surface. In an embodiment, the device includes at least one aperture formed between the first and second surfaces. In an embodiment, the device includes a second deflector positioned upstream of the sensor and downstream of the first deflector in the direction of oncoming flow. In an embodiment, the surfaces are comprised of a ceramic material. In an embodiment, the device includes a heating element disposed near the deflector to increase temperature in the vicinity of the deflector to burn off particulate matter accumulated near the deflector. In an embodiment, the surface includes a plurality of perforations through which exhaust gas flows. In an embodiment, the deflector includes a bluff body that generates vortices in the flow of exhaust gas in a vicinity of the sensor. In an embodiment, the bluff body includes a curved surface facing the direction of oncoming flow of exhaust gas. In an embodiment, a surface of the bluff body facing the direction of oncoming flow of exhaust gas is comprised of a ceramic material.

In an embodiment, a device for protecting a sensor in an exhaust gas conduit in an internal combustion engine system includes an interdigital transducer positioned on a side of a surface of the sensor that propagates surface acoustic waves across the surface. In an embodiment, the surface acoustic waves dislodge particulate matter from the surface of the sensor. In an embodiment, a velocity of the surface acoustic waves is detected by a second interdigital transducer of the device, which generates electrical signals indicating the detected velocity. In an embodiment, a controller of the engine system receives the electrical signals and estimates an amount of accumulated particulate matter on the surface of the sensor based on the electrical signals. In an embodiment, the controller triggers a burn-off event based on an estimated amount of accumulated particulate matter that exceeds a threshold amount.

In an embodiment, a device for protecting a sensor from particulate matter accumulation in an exhaust gas conduit in an internal combustion engine includes an injector positioned in proximity to the sensor, configured to direct bursts of pressurized gas toward the sensor at high frequencies to generate ultrasonic waves that impinge upon the sensor.

In an embodiment, a device for protecting a sensor from particulate matter accumulation in an exhaust gas conduit in an internal combustion engine includes a first electrode positioned upstream of the sensor in a direction of oncoming flow of the exhaust gas, where the first electrode generates an electrical field in a cavity in the conduit, such that exhaust gas flow flowing in the cavity upstream of the sensor element is exposed to the electrical field, attracting charged particles in the exhaust gas toward the first electrode. In an embodiment, the device further includes a second electrode, wherein each electrode conducts a positive or negative electrical charge. In an embodiment, the device includes a heating element disposed near the electrodes to increase temperature in the vicinity of the electrodes to burn off particulate matter accumulated near the electrodes.

Many aspects of this disclosure are described in terms of sequences of actions to be performed by elements of a system, such as modules, a controller, a processor, a memory, and/or a computer system or other hardware capable of executing programmed instructions. Those of skill in the art will recognize that these elements can be embodied in an engine controller of an engine system, such as an engine control unit (ECU), also described as an engine control module (ECM), or in a controller separate from, and communicating with an ECU. In some embodiments, the engine controller can be part of a controller area network (CAN) in which the controller, sensor, actuators communicate via digital CAN messages. It will be recognized that in each of the embodiments, the various actions for implementing the regeneration optimization strategy disclosed herein could be performed by specialized circuits (e.g., discrete logic gates interconnected to perform a specialized function), by application-specific integrated circuits (ASICs), by program instructions (e.g. program modules) executed by one or more processors (e.g., a central processing unit (CPU) or microprocessor or a number of the same), or by a combination of circuits, instructions, and processors. All of which can be implemented in a hardware and/or software of the ECU and/or other controller or plural controllers.

Logic of embodiments consistent with the disclosure can be implemented with any type of appropriate hardware and/or software, with portions residing in the form of computer readable storage medium with a control algorithm recorded thereon such as the executable logic and instructions disclosed herein. The hardware or software may be on-board or distributed among on-board and off-board components operatively connected for communication. The hardware or software can be programmed to include one or more singular or multidimensional lookup tables and/or calibration parameters. The computer readable medium can comprise a random access memory (RAM), a read-only memory (ROM), an erasable programmable read-only memory (EPROM or Flash memory), an optical fiber, a portable compact disc read-only memory (CD-ROM), or any other solid-state, magnetic, and/or optical disk medium capable of storing information. Thus, various aspects can be embodied in many different forms, and all such forms are contemplated to be consistent with this disclosure.

One of skill in the art may appreciate from the foregoing that unexpected benefits are derived from application of the method, system, and apparatus to the problem of controlling particulate matter in exhaust gas flow in an engine system, without the need for additional components or parts, or changes in the configuration of a conventional vehicle or its features. Changes to configuration of a conventional engine system may add costs, weight, and complexity to manufacture, operation, and maintenance of the engine system. A key benefit contemplated by the inventors is improvement of control of particulate matter in exhaust gas flow in a conventional engine system through use of the disclosed system, method, or apparatus, while excluding any additional components, steps, or change in structural features. In this exclusion, maximum cost containment may be effected. Accordingly, the substantial benefits of simplicity of manufacture, operation, and maintenance of standard or conventionally produced vehicles as to which the method and system may be applied may reside in an embodiment of the disclosure consisting of or consisting essentially of features of the method, system, or apparatus disclosed herein. Thus, embodiments of the disclosure explicitly contemplate the exclusion of steps, features, parts, and components beyond those set forth herein. The inventors contemplate, in some embodiments, the exclusion of certain steps, features, parts, and components that are set forth in this disclosure even when such are identified as preferred or preferable.

It is to be understood that the above description is intended to be illustrative, and not restrictive. Many other embodiments will be apparent to those of skill in the art upon reading and understanding the above description. For example, it is contemplated that features described in association with one embodiment are optionally employed in addition or as an alternative to features described in association with another embodiment. The scope of the invention should, therefore, be determined with reference to the appended claims, along with the full scope of equivalents to which such claims are entitled.

What is claimed is:

1. A device for protecting a sensor from particulate matter accumulation in an exhaust gas conduit in an internal combustion engine, comprising:

a deflector, wherein the deflector comprises a bluff body positioned upstream of the sensor in a direction of flow of oncoming flow of exhaust gas in the exhaust gas conduit, wherein the bluff body is formed as a sphere or a cylinder connected to an inner surface of the exhaust gas conduit with an affixation rod or cylinder that extends between the bluff body and the inner surface, wherein the bluff body is configured to generate vortices in the flow of exhaust gas in a vicinity of the sensor that remove particulate matter accumulation on the sensor.

2. The device according to claim 1, wherein the bluff body comprises a curved surface facing the direction of oncoming flow of exhaust gas.

3. The device according to claim 1, wherein a surface of the bluff body facing the direction of oncoming flow of exhaust gas is comprised of a ceramic material.

4. A device for protecting a sensor from particulate matter accumulation in an exhaust gas conduit in an internal combustion engine, comprising:

a bluff body formed as a sphere or a cylinder connected to an inner surface of the exhaust gas conduit with an affixation rod or cylinder that extends between the bluff body and the inner surface, wherein the bluff body is positioned upstream of the sensor in a direction of flow of oncoming flow of exhaust gas in the exhaust gas conduit, wherein the bluff body is configured to deflect the flow of exhaust gas to generate vortices in a vicinity of the sensor in order to remove particulate matter accumulation on the sensor.

5. The device according to claim 4, wherein the bluff body comprises a curved surface facing the direction of oncoming flow of exhaust gas.

6. The device according to claim 4, wherein a surface of the bluff body facing the direction of oncoming flow of exhaust gas is comprised of a ceramic material.

* * * * *